US008063840B2

(12) United States Patent
Matthews et al.

(10) Patent No.: US 8,063,840 B2
(45) Date of Patent: Nov. 22, 2011

(54) ANTENNA OPERABLE ACROSS MULTIPLE FREQUENCIES WHILE MAINTAINING SUBSTANTIALLY UNIFORM BEAM SHAPE

(75) Inventors: James Christopher Gordon Matthews, Colchester (GB); Robert Alan Lewis, Maldon (GB); Christian Rieckmann, Darmstadt (DE)

(73) Assignee: BAE Systems plc, London (GB)

( * ) Notice: Subject to any disclaimer, the term of this patent is extended or adjusted under 35 U.S.C. 154(b) by 77 days.

(21) Appl. No.: 11/886,657

(22) PCT Filed: May 8, 2007

(86) PCT No.: PCT/GB2007/050241

§ 371 (c)(1),
(2), (4) Date: Sep. 10, 2009

(87) PCT Pub. No.: WO2007/132262

PCT Pub. Date: Nov. 22, 2007

(65) Prior Publication Data

US 2010/0013726 A1 Jan. 21, 2010

(30) Foreign Application Priority Data

May 11, 2006 (EP) ..... 06270047
May 11, 2006 (GB) ..... 0609295.1

(51) Int. Cl.
*H01Q 19/06* (2006.01)

(52) U.S. Cl. ..... 343/753; 343/795

(58) Field of Classification Search ..... 343/753, 343/700 MS, 853, 795
See application file for complete search history.

(56) References Cited

U.S. PATENT DOCUMENTS

| | | | | |
|---|---|---|---|---|
| 4,626,858 | A | 12/1986 | Copeland | |
| 5,485,167 | A | 1/1996 | Wong et al. | |
| 5,708,679 | A * | 1/1998 | Fernandes et al. | 375/259 |
| 6,118,406 | A | 9/2000 | Josypenko | |
| 2003/0052825 | A1 | 3/2003 | Rao et al. | |
| 2003/0146872 | A1 * | 8/2003 | Kellerman et al. | 343/700 MS |

FOREIGN PATENT DOCUMENTS

| | | |
|---|---|---|
| DE | 44 30 832 A1 | 11/1995 |
| WO | WO 94/26001 | 11/1994 |

OTHER PUBLICATIONS

Gunderson, L.C., "An Electromagnetic Analysis of a Cylindrical Homogeneous Lens," IEEE Transactions of Antennas and Propagation, Jul. 1972, pp. 476-479.

* cited by examiner

*Primary Examiner* — Hoanganh Le
(74) *Attorney, Agent, or Firm* — Jacobson Holman PLLC

(57) ABSTRACT

An antenna including a number of antenna units, each having a lens and an array of beam ports. The antenna units are arranged in a stack, and are configured to transmit or receive signals from the same field-of-view. Each unit is configured to operate in a different frequency band, with the lenses being configured such that an approximately constant beam shape is maintained across the entire operating bandwidth of the antenna.

10 Claims, 2 Drawing Sheets

ANTENNA OPERABLE ACROSS MULTIPLE FREQUENCIES WHILE MAINTAINING SUBSTANTIALLY UNIFORM BEAM SHAPE

This is a national stage of PCT/GB07/050241 filed May 8, 2007 and published in English, which has a priority of United Kingdom no. 0609295.1 filed May 11, 2006, and European no. 06270047.1 filed May 11, 2006, hereby incorporated by reference.

BACKGROUND OF THE INVENTION

1. Field of the Invention

This invention relates to an antenna, and more particularly to an antenna operable to transmit and receive signals across a range of frequencies whilst maintaining a uniform beam shape.

2. Description of the Related Art

There exist a number of applications in which it is desirable for an antenna to be able to scan across a broad range of frequencies. In some cases, it is further desirable for such antennas to provide broad spatial coverage. In order to be able to scan across a spatially large area, and provide consistency throughout the relevant frequency band, it is necessary for the beamwidth to remain constant throughout the relevant frequency range. This can be difficult, because the electrical size of any antenna aperture changes with frequency, normally resulting in a change of beam shape with frequency: as the frequency increases, the beam becomes narrower. A number of apodising technologies exist that can overcome these problems—for example, the effective aperture of an antenna comprising a number of antenna elements can be controlled by adjusting the signal amplitude at each element with frequency. However, these technologies are complex and expensive.

There thus exists a need for an antenna that, is both inexpensive and simple to fabricate whilst still achieving the functionality described above.

SUMMARY OF THE INVENTION

According to one aspect of the present invention, there is provided an antenna comprising first and second antenna units arranged in a stack, wherein the first and second antenna units are configured to operate in first and second, different, frequency bands, and wherein the first and second antenna units are configured to transmit or receive signals to or from a first field-of-view. Conveniently, the first antenna unit is configured to operate in the first frequency band, and the second antenna unit is configured to operate in the second frequency band. By providing separate antenna units to work in separate frequency bands, the beam shape can be kept at least approximately constant across the entire band. Whilst there will be some variation in beam shape within the first and second frequency bands, the antenna provides a simpler solution to the problem of maintaining a constant beam shape than currently-known antennas. There will be many applications in which the approximately-constant beam shape provided by the present invention will be adequate. Such applications, in which it is currently necessary to use more complex and expensive apodising systems, will benefit from a cheaper antenna at the expense of an (acceptable) reduction in performance. Arrangement of the antenna units in the form of a stack enables the antenna to be fabricated using simple manufacturing processes.

The first antenna unit may comprise a first lens and a first array of beam ports, and the second antenna unit may comprise a second lens and a second array of beam ports; and the first and second antenna units may be configured such that the first and second arrays of beam ports are operable to provide approximately the same beam shape. The first and second lenses may be cylindrical lenses, which conveniently produce fan-beams. Advantageously, the stacking arrangement provides more space for a large number of beam ports. Moreover, the first and second lenses can be chosen to be of a particular size such that the beams produced by each lens are of approximately the same shape. This is readily achieved using cylindrical lenses, which are simple to manufacture to any given specification.

The antenna may further comprise a third antenna unit configured to operate in a third frequency band, different to the first and second frequency bands, and configured to transmit or receive signals to or from the first field-of-view. Thus the antenna can be adapted to cover a larger range of frequencies, whilst still keeping an approximately constant beam shape, by adding an extra antenna unit. Alternatively, a more uniform beam shape can be achieved across given frequency range by increasing the number of antenna units present in the stack.

Optionally, the frequency bands in combination may form a continuous frequency band. Alternatively, the antenna may be configured to provide multi-band coverage.

Preferably, the antenna units are separated by a dielectric sheet. The dielectric sheet serves to isolate each antenna unit from the other antenna units, thereby preventing interference between signals transmitted or received by each unit.

Conveniently, the antenna further comprises a switching network operable to select one or more of the beam ports. The switching network may be a binary switching network. Binary switching networks are a known and convenient form of switching network. Advantageously, a binary switching network allows any element to be selected at any one time. Thus the beam ports can, for example, be scanned in sequence, or as desired depending on the particular application of the antenna.

Optionally, each beam port comprises a bow-tie element.

The antenna may further comprise a broad band element arranged to transmit or receive signals from a second field-of-view. The presence of such an element enables the spatial coverage of the antenna to be extended to a complete hemisphere.

BRIEF DESCRIPTION OF THE DRAWINGS

The invention will now be described, by way of example only, with reference to the accompanying drawings in which.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
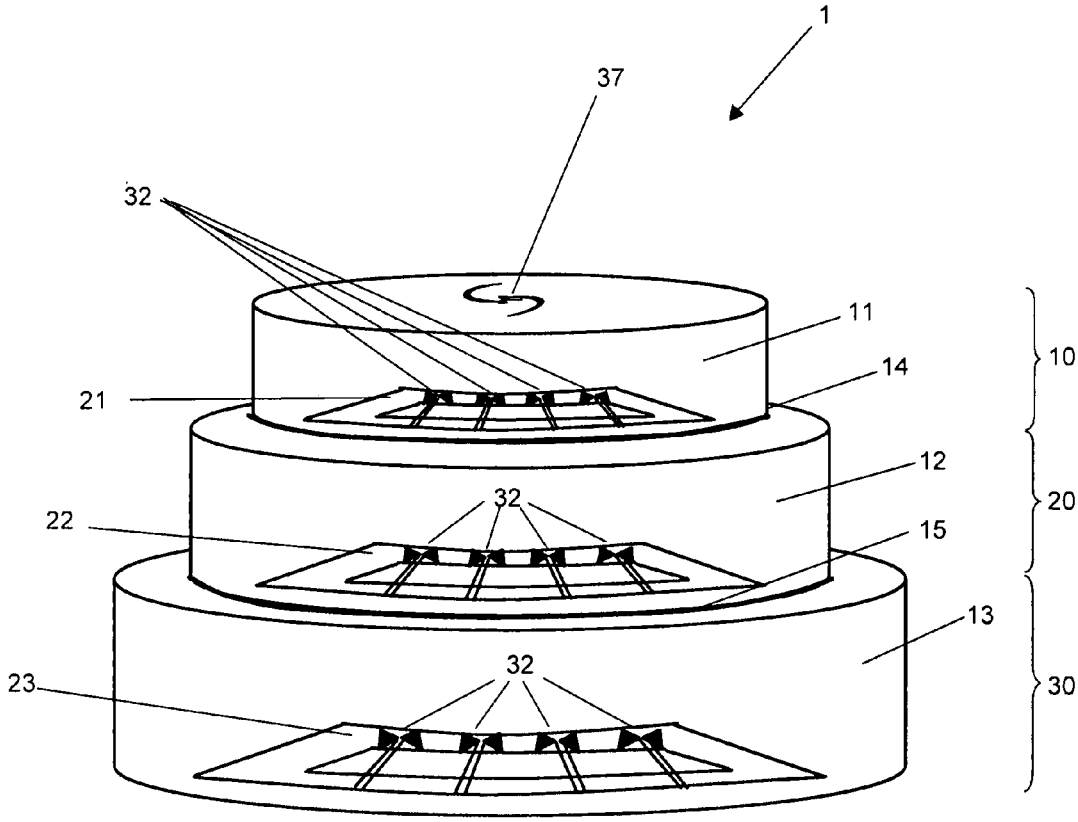
FIG. 1 is a side perspective for an antenna according to this invention for transmitting three frequency ranges.

In FIG. 1 an antenna 1, in accordance with a first embodiment of the invention, comprises three antenna units 10, 20, 30. Each unit comprises a cylindrical lens and an array of beam ports: unit 10 comprises lens 11 and array 21; unit 20 comprises lens 12 and array 22; and unit 30 comprises lens 13 and array 23. Cylindrical lenses 11, 12 and 13 are manufactured from polytetrafluorethylene and are arranged in a coaxial stack. It will be noted that the three cylindrical lenses are of different sizes, lens 11 having the smallest diameter and the smallest axial dimension, lens 13 having largest diameter and the largest axial dimension, whilst the dimensions of lens 12 are intermediate those of lenses 11 and 13.

Cylindrical single index lenses are simple to manufacture. IEEE Transactions on Antennas and Propagation of July 1972, pages 476-479, has an article by L. C. Gunderson entitled "An Electromagnetic Analysis of a Cylindrical Homogenous Lens" which gives background information concerning cylindrical lenses. Rather than repeating this technical disclosure, it is imported herein by reference.

The beam port arrays 21, 22 and 23 are each formed from an arcuate series of beam ports each of which comprises a terminal and a feed element 32 in the form of a bow-tie element as shown. Each of the arrays 21, 22 and 23 is provided on the base of one of the cylindrical lenses 11, 12, 13, and is positioned such that the beam ports are on or near the focal surface of the lens. The focal surface, for a cylindrical lens such as lenses 11, 12, and 13, is located a small electrical distance from the outer (curved) surface of the lens. The precise position of the focal surface can be modified, if necessary, using known techniques, in order to ensure that there is sufficient space available in which to position the beam ports. Such an arrangement results, when the antenna 11 is used as a transmitter, in the production of nearly symmetric fan beams.

The physical size of a cylindrical lens is fixed. Its electrical size is related to its physical size, but will vary with frequency. The effective aperture defined by the cylindrical lenses, therefore, is different at different frequencies. This means that the beam shape formed by a cylindrical lens will vary with frequency. At higher frequencies the beam is narrower and has higher gain. In many applications it is important that beam width is at least approximately constant across the range of frequencies in which the antenna is designed to operate. For example, this is important when scanning through a section of the antenna field-of-view. Constant beam width is achieved by sizing lenses 11, 12 and 13 appropriately. The maximum size of lenses 11, 12, and 13 is expected to be of order 20 cm to 30 cm, although it is noted that appropriate sizes can be readily determined by experiment. Lens 11 is sized to operate in the frequency range 8 to 18 GHz, whilst lens 12 is sized to operate in the frequency range 4 to 8 GHz, and lens 13 is sized to operate in the frequency range 2 to 4 GHz. As a result, the antenna covers a frequency range of 2 to 18 GHz and is able to maintain an at least approximately constant beam width across this frequency range.

The beam width will, of course, vary within the frequency ranges 8 to 18 GHz, 4 to 8 GHz, and 2 to 4 GHz, but, by splitting the larger band (2 to 18 GHz) into three sub-bands, the variation of beam width can be reduced to be within acceptable limits, such that scanning functionality, for example, is still possible. The degree of variation within each sub-band will depend on factors including the specific construction of the cylindrical lenses 11, 12, and 13, and the specific construction of the beam port arrays 21, 22 and 23. Such variations can be controlled using techniques known to those skilled in the art. Moreover, it is noted that the acceptable limits of such variations will depend strongly on the application to which the antenna 1 is to be used.

Antenna units 10 and 20 are separated by a thin circular dielectric sheet 14, and the units 20 and 30 are similarly separated by a thin circular dielectric sheet 15. The dielectric sheets 14 and 15 improve the performance of the antenna 1 by reducing interference between signals produced or received in each lens.

The antenna 1 is designed to transmit or receive a wide band of frequencies within a part-spherical zone. Each of the bow-tie feed-elements 32 transmits or receives a horizontal conical beam through one of the cylindrical lens 11, 12 or 13. When transmitting RF, the cylindrical lenses 11, 12, 13 constrain the beams horizontally such that the transmitted RF beams are of fan cross-section, arranged either side-by-side in azimuth, or slightly overlapped. As a consequence, the antenna transmits over a part-spherical zone diverging from the horizontal to a steeply inclined angle, the radial depth of the zone depending on the power of the RF signal applied to the bow-tie feed-elements 32. By selecting which feed elements 32 are connected to the RF source, the antenna will transmit RF to the corresponding vertical sector of the part-spherical zone.

Conversely, when receiving RF, each cylindrical lens 11 receives RF from the part-spherical zone, such that any signal received from one of the fan-shaped zones will be focussed onto the corresponding bow-tie receptor element 32. By detecting the receptor element 32 that receives a signal, the general direction of the source of the signal is known. Detection can be achieved, for example, by scanning through each receptor element 32 in sequence through use of an appropriate switching network, such as that described below.

Irrespective of whether the antenna 11 is transmitting or receiving, the three units 10, 20 and 30 have the same field-of-view. Each unit covers the same part-spherical zone but for different frequency ranges, so that there is simultaneous coverage of each frequency range for any given scan angle. It is noted that the spatial resolution achievable using the antenna 10, whether transmitting or receiving, will increase as the number of beam ports increase.

The maximum spatial coverage achievable with antenna 1 is obtained when bow-tie elements 32 are arranged around approximately one quarter of the perimeter of each of the cylindrical lenses 11, 12, and 13. Placing elements around more than one quarter of the perimeter of a cylindrical lens can result in blockage effects. A broadband element 37 is carried by the upper circular area of the uppermost cylindrical lens 11 as shown in FIG. 1. Broadband element 37 provides an additional field-of-view to that provided by units 10, 20, 30. When positioned on the top of the antenna, as illustrated, it provides coverage in the area above the fan-shaped beams covered by units 10, 20, 30.

Figure 2:
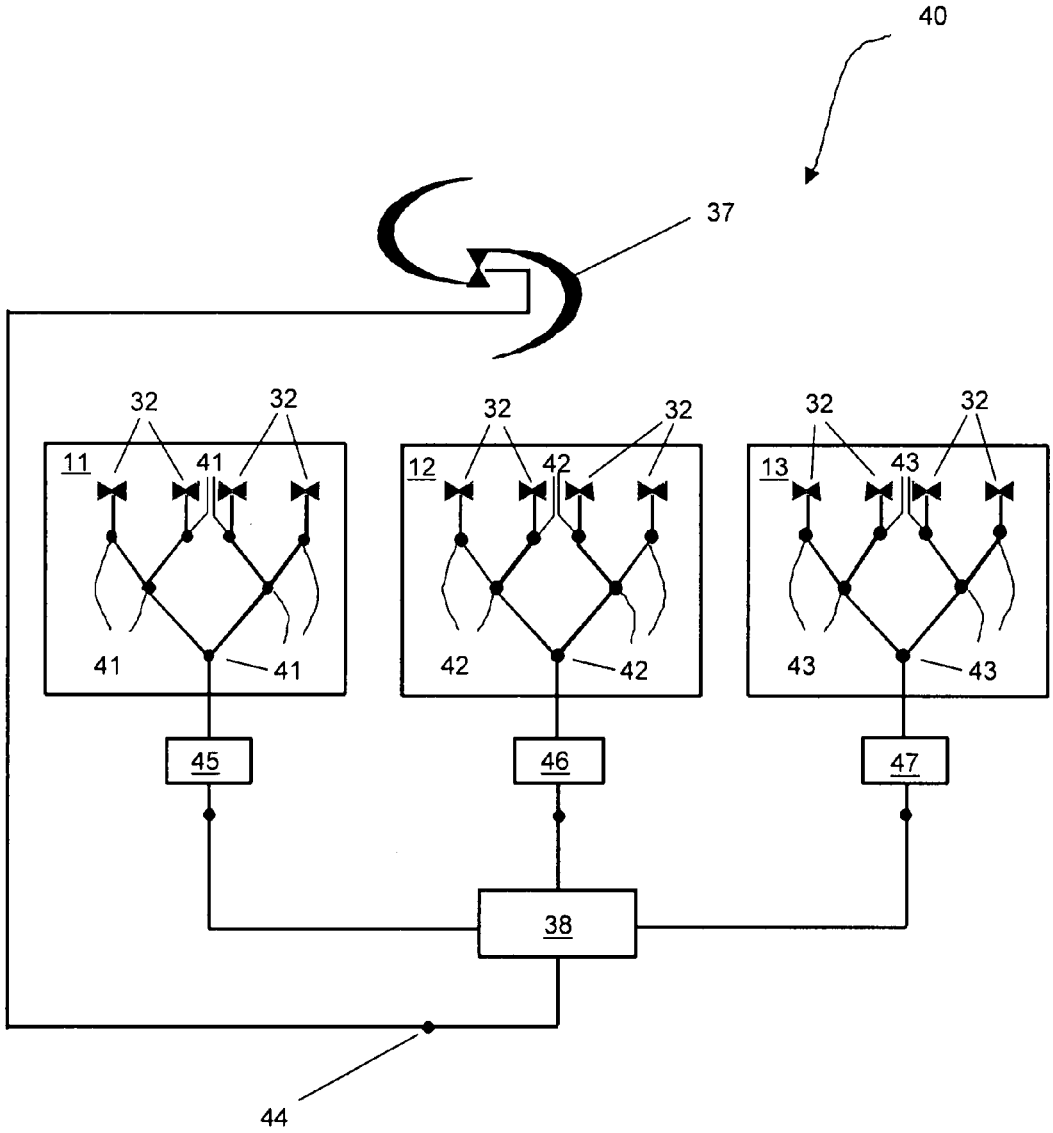
FIG. 2 is a circuit diagram illustrating the switching of the beam ports.

FIG. 2 illustrates one manner of scanning the RF output or input 38 to the various beam ports of the three cylindrical lenses 11, 12, 13 and to the broad band element 37.

Switching network 40 comprises switches 41, 42, 43 and 44. Switches 41 form a binary network configured to connect one of beam ports 32 of antenna unit 10 to the RF input or output 38. Similarly, switches 42 select a beam port 32 of unit 20, and switches 43 select a beam port 32 of unit 30. Switch 44 enables a connection to be made to the broadband element 37. Between RF input or output 38 and each antenna unit 10, 20, 30 is a filter 45, 46 or 47 respectively. Filters 45, 46, 47 select the appropriate frequency band for each respective unit 10, 20, 30. Filter 45 is a high-pass filter, such that, when operating in transmission mode, any output from RF output 38 outside the range 8-18 GHz is removed from the input to unit 10 by filter 45. Filters 46 and 47 band-pass and low-pass filters respectively, that operate similarly for units 30 20 and 30. No filter is present for broadband element 37.

With this configuration it will be noted that selected beam ports of the three lenses are activated together so that the fan beams 33 at the same azimuth angle are operated together whereby the full antenna frequency range is switched to the selected azimuth angle.

In accordance with a second embodiment of the invention, there is provided an antenna system comprising a number of antennae 1. Additional field-of-view can be achieved by such an antenna system. For example, in order to provide full hemispherical coverage, four antennae 1 are provided, each having beam ports arranged around one quarter of the perimeters of each of their antennae units, and orientated so as to provide complimentary spatial coverage. One of the antennae is provided with a broadband element (such as broadband element 37 illustrated in FIGS. 1 and 2) to provide coverage of the area above the fan-shaped beams provided by each of the antennae: in contrast to the antenna 1 according to the above-described first embodiment of the invention, the remaining three antennae in the antenna system are not provided with a broadband element.

Having described the invention with reference to particular embodiments, it is to be noted that this embodiment is in all respects exemplary. Variations to the above-described embodiment are envisaged. For example, the pattern, or patterns, of selecting which beam ports are to be operable can be arranged to cover the operational requirements of the antenna. It may, for example, be desirable to operate several beam pots along an arc simultaneously, such that a particular antenna unit is array-fed. Such an arrangement provides further degrees of freedom with which side-lobes, for example, can be controlled. Moreover, it should be noted that the lenses 11, 12 and 13 do not have to be single index, and the sequence of stacking them is not important. In addition, whilst, in the above, it has been described to form a stack comprising three antenna units, it is to be clearly understood that it would be possible to form antennas comprising stacks of four or more antenna units. Other variations to the above-described embodiment are possible without departing from the spirit and scope of the invention, and all such modifications as would be recognized by one skilled in the art are intended to be included within the scope of the accompanying claims.

The invention claimed is:

1. An antenna comprising:

first and second antenna units arranged in a stack;

said first and second antenna units being configured to operate in a first frequency and a second frequency, respectively, with said first and second frequencies being different from one another, and the first and second antenna units being configured to transmit or receive signals to or from a first field-of-view;

said first antenna unit including a first lens and a first array of beam ports, and the second antenna unit including a second lens and a second array of beam ports; and the first and second antenna units being configured such that the first and second arrays of beam ports are operable to provide approximately the same beam shape.

2. The antenna as claimed in claim 1, wherein the first and second lenses comprise cylindrical lenses.

3. The antenna as claimed in claim 1, further comprising a third antenna unit configured to operate in a third frequency band, different from the first and second frequency bands, and configured to transmit or receive signals to or from the first field-of-view.

4. The antenna as claimed in claim 1 wherein the frequency bands in combination form a continuous frequency band.

5. The antenna as claimed in claim 1 wherein the antenna units are separated by a dielectric sheet.

6. The antenna as claimed in claim 1 further comprising a switching network operable to select one or more of the beam ports.

7. The antenna as claimed in claim 6 wherein the switching network is a binary switching network.

8. The antenna as claimed in claim 1 wherein each beam port includes a bow-tie element.

9. The antenna as claimed in claim 1, further comprising a broadband element arranged to transmit or receive signals from a second field-of-view.

10. The antenna as claimed in claim 1, wherein the first and second antenna units are sized differently to obtain approximately the same beam shape across the range of frequencies in which the antenna is designed to operate.

* * * * *